US012259215B2

(12) United States Patent
Ricker et al.

(10) Patent No.: US 12,259,215 B2
(45) Date of Patent: Mar. 25, 2025

(54) RAMROD FOR A MUZZLELOADING FIREARM

(71) Applicant: Traditional Sporting Goods, Inc., Old Saybrook, CT (US)

(72) Inventors: Karl K. Ricker, Brookfield, NH (US); Thomas F. Hall, Higganum, CT (US); Ryan Nicholas, Scottsdale, AZ (US)

(73) Assignee: Traditional Sporting Goods, Inc., Old Saybrook, CT (US)

( * ) Notice: Subject to any disclaimer, the term of this patent is extended or adjusted under 35 U.S.C. 154(b) by 33 days.

(21) Appl. No.: 18/329,046

(22) Filed: Jun. 5, 2023

(65) Prior Publication Data

US 2024/0401906 A1 Dec. 5, 2024

(51) Int. Cl.
*F41C 9/08* (2006.01)

(52) U.S. Cl.
CPC ..... *F41C 9/085* (2013.01)

(58) Field of Classification Search
CPC ..... F41A 29/02; F41A 15/22; F41C 9/08
USPC ..... 42/90, 95, 51; 89/1.3
See application file for complete search history.

(56) References Cited

U.S. PATENT DOCUMENTS 464,099 A * 12/1891 Jurnitschek Von Wehrstedt ..... F41A 29/02 42/95
1,175,256 A * 3/1916 Gruver ..... F41A 29/02 42/95
1,192,174 A * 7/1916 Dvorak ..... F41A 29/02 403/182
1,556,494 A * 10/1925 Cooper ..... F41A 29/02 42/95
1,665,988 A * 4/1928 Smith ..... F41A 29/02 15/104.165
2,379,962 A * 7/1945 Hoerle ..... F41A 29/02 15/104.165
2,834,973 A * 5/1958 Friesen ..... F41A 29/02 15/104.165
3,208,302 A * 9/1965 Lewis ..... F41A 29/02 403/258
3,402,950 A * 9/1968 Hertzberg ..... F41A 29/02 403/112
4,327,515 A * 5/1982 Kuryn ..... F41C 9/085 42/90
4,407,086 A * 10/1983 Hasselmann ..... F41A 15/22 42/90

(Continued)

*Primary Examiner* — Michael D David
(74) *Attorney, Agent, or Firm* — DeLio Peterson & Curcio LLC; Robert Curcio

(57) ABSTRACT

A ramrod for a muzzleloading firearm and method of using the same. The ramrod comprises an elongated ramrod outer body having a hollow portion and an exterior size and shape permissible for insertion into the firearm bore. An extension member is movable within the outer body hollow portion, and includes a clasping member which is foldable between a stowed position in which the clasping member is generally aligned with the longitudinal axis of the outer body to a working position in which the clasping member makes a substantial angle with respect to the outer body longitudinal axis. The extension member is movable between a retracted position wherein a first length of the extension member is within the outer body hollow portion to an extended position wherein the first length of the extension member is outside the outer body hollow portion.

13 Claims, 8 Drawing Sheets

(56) References Cited

U.S. PATENT DOCUMENTS 4,414,770 A * 11/1983 Brinton, Sr. ..... F42B 33/14 42/90
4,843,747 A * 7/1989 Echeberria ..... F41C 9/085 42/90
4,875,303 A * 10/1989 DeWeert ..... F41C 9/085 42/90
4,890,406 A * 1/1990 French ..... F41C 9/085 42/95
4,899,415 A * 2/1990 Wheeler ..... F41A 29/02 81/177.1
4,912,868 A * 4/1990 Thompson ..... F41C 9/08 42/51
4,930,204 A * 6/1990 Schurter ..... B29C 65/56 29/469.5
5,127,179 A * 7/1992 Marsh ..... F41C 9/085 42/95
5,204,483 A * 4/1993 Tellechea ..... F41A 29/02 42/95
5,375,358 A * 12/1994 Riness ..... F41C 9/08 42/32
5,379,542 A * 1/1995 Guzman ..... B25F 1/02 30/169
5,404,666 A * 4/1995 Cline, Jr. ..... F41A 29/02 42/90
5,416,940 A * 5/1995 Bandera ..... B25F 1/04 7/118
5,651,207 A * 7/1997 Knight ..... F41A 29/00 89/31
5,657,570 A * 8/1997 Sigier Emmanuel ... F41A 29/02 42/95
5,934,000 A * 8/1999 Hayes, Sr. ..... F41A 29/02 42/95
6,145,235 A * 11/2000 Emerson ..... F41C 9/085 42/95
6,336,284 B1 * 1/2002 Rotell, III ..... F41C 9/085 42/95
6,379,020 B1 * 4/2002 Lewis ..... B25B 23/18 362/120
6,604,311 B1 * 8/2003 Laney ..... F41A 3/06 42/51
RE38,247 E * 9/2003 Wickser, Jr. ..... F41A 29/02 42/95
6,981,345 B1 * 1/2006 Gunn ..... F41A 29/02 42/95
7,065,913 B2 * 6/2006 Lizarralde ..... F41A 3/06 42/51
7,249,433 B2 * 7/2007 Wilson ..... F41C 9/085 42/108
7,281,450 B1 * 10/2007 Weinraub ..... E05B 19/20 81/488
7,441,363 B1 * 10/2008 Black ..... F41A 29/00 15/104.03
7,481,015 B2 * 1/2009 Mays ..... F41A 29/02 42/51
7,774,971 B2 * 8/2010 Laney ..... F41A 3/64 89/1.3
8,607,494 B2 * 12/2013 Shipman ..... F41A 29/02 42/95
8,991,089 B2 3/2015 Hunsaker
9,146,086 B2 * 9/2015 Peterson ..... F41A 3/00
9,279,637 B2 3/2016 Hunsaker
9,291,419 B2 * 3/2016 Shipman ..... F41A 29/02
9,329,003 B2 * 5/2016 Peterson ..... F42B 14/04
9,772,160 B2 * 9/2017 Sain ..... F41A 35/00
10,030,956 B2 * 7/2018 Peterson, Sr. ..... F42B 14/064
10,605,577 B2 * 3/2020 Peterson ..... F41C 9/085
10,801,799 B2 * 10/2020 Hunsaker ..... F41A 29/02
11,231,244 B1 * 1/2022 Sturdevant ..... F41A 11/00
11,668,549 B2 * 6/2023 Peterson ..... F42B 8/04 42/51
2006/0005446 A1 * 1/2006 Lee ..... F41C 9/08 42/90
2010/0000396 A1 * 1/2010 Brown ..... F41A 3/72 89/1.4
2014/0060294 A1 * 3/2014 Brown ..... F41A 7/00 89/1.4

* cited by examiner

FIG. 3B
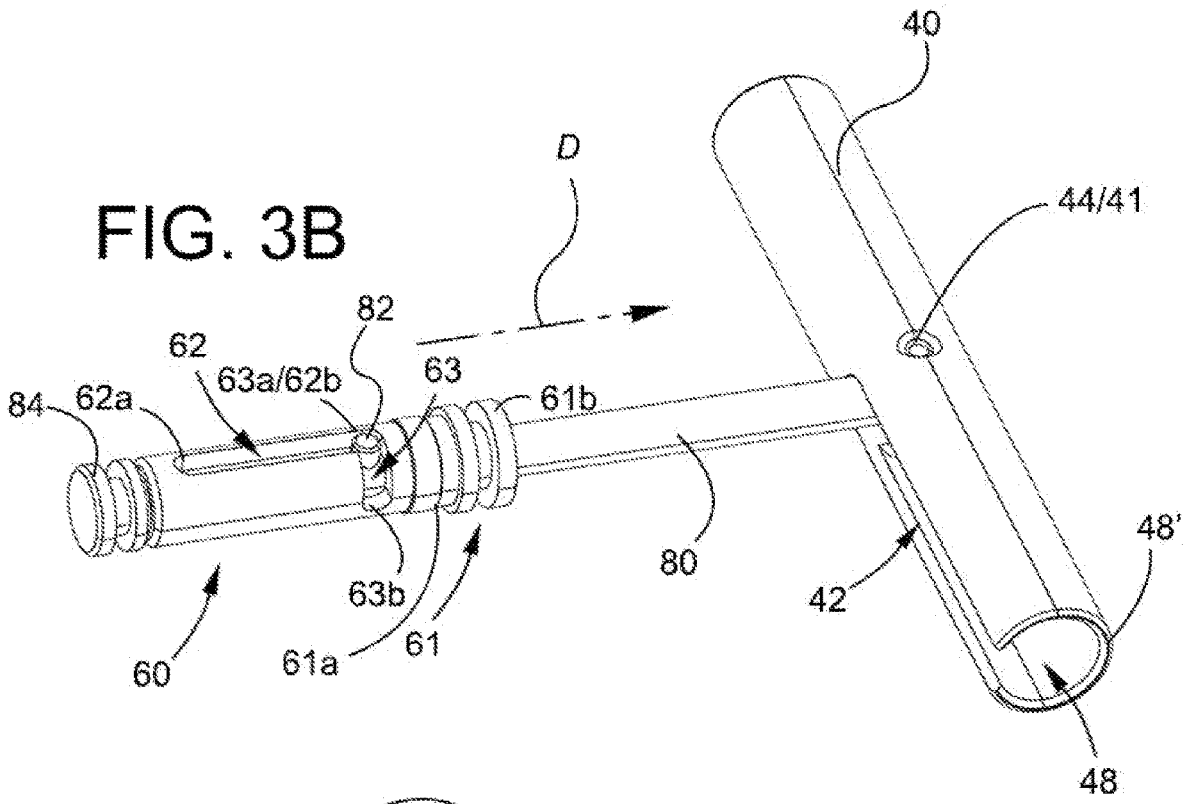
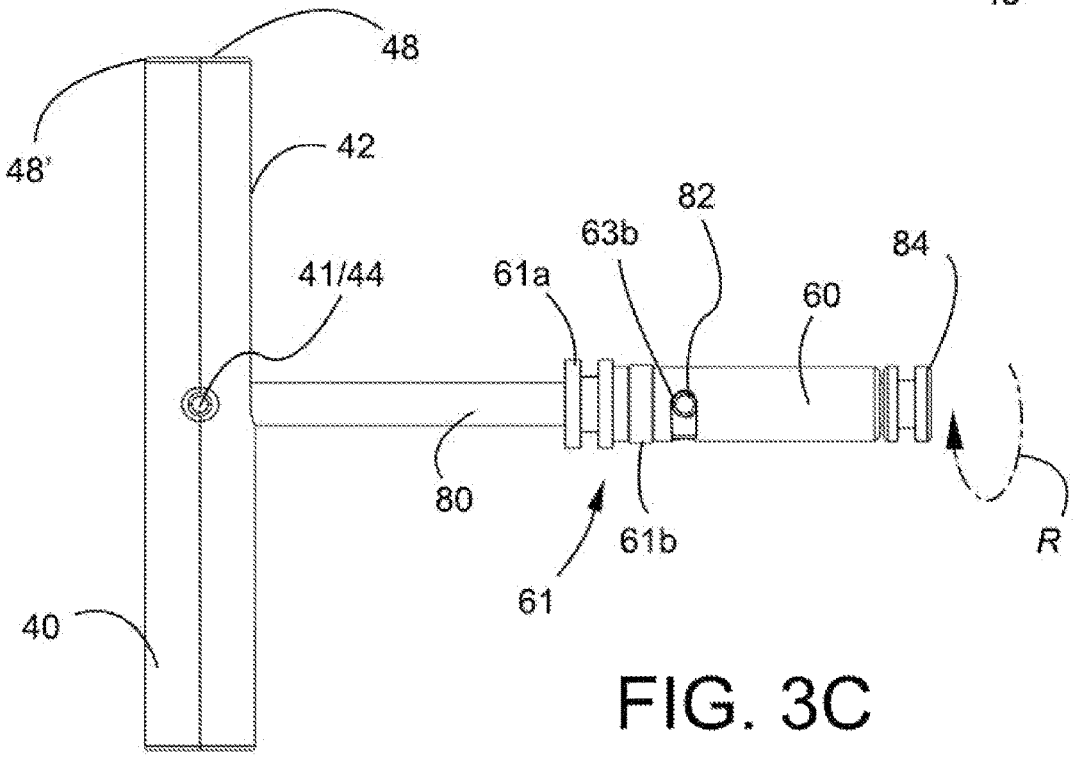
FIG. 3C

RAMROD FOR A MUZZLELOADING FIREARM

BACKGROUND OF THE INVENTION

1. Field of the Invention

The present invention relates generally to the field of firearms, and more particularly to a ramrod for use with muzzleloading firearms.

2. Description of the Related Art

Generally, muzzleloading firearms are any projectile launcher in which the propellant charge and the projectile to be discharged are loaded into the launcher by way of the forward, open end of the launcher's barrel, called the muzzle. A typical loading operation for muzzleloading firearms ("muzzleloader") comprises inserting a measured amount of propellant charge into the muzzle, followed by the insertion of the projectile into the muzzle. In many cases, wadding, which may be a piece of fabric, felt, cloth, card or the like is placed around/behind the projectile, such that the wadding is between the propellant charge and projectile after loading. To ensure optimum pressures within the barrel and proper launching of the projectile, a ramrod is utilized to drive the wadding and projectile down the barrel to ensure firm seating of the projectile and wadding on the propellant charge.

The ramrod is necessarily designed as a straight cylindrical rod that has a diameter that is smaller than the bore of the barrel to ensure proper loading of the projectile and wadding without damaging the barrel's bore after loading. Since a ramrod is essential to muzzleloader loading and cleaning operations, it is often stored on the underside of the barrel within metal ferrules ("thimbles") for swift and easy access by the operator. When needed, the operator may remove the ramrod by sliding, or otherwise removing the ramrod from the thimbles on the barrel underside, insert the ramrod into the barrel via the muzzle, and repeatedly and vigorously move the ramrod up and down within the barrel to properly compact the projectile and propellant charge in the muzzleloader. After loading, the operator will remove the ramrod from the barrel, and subsequently secure the ramrod within the thimbles until needed again.

Conventional ramrods of the prior art often require disassembly and re-assembly prior to use in the field to load or reload the muzzleloader due to the length of ramrod required and receiver design. Currently when loading the muzzleloader, the ramrod must be removed from the thimbles, and any auxiliary handle to aid the user must be removed from the ramrod and set aside. The ramrod loading tip is then un-threaded rotated 180 degrees and re-threaded increasing the ramrod overall length (e.g., an additional 2 inches), allowing proper reload operations. The user then places the auxiliary handle on the end of the rod, opposite of the loading jag, and seats the bullet. The same process is utilized to clean the muzzleloader after loading. In some cases, the ramrods of the prior art include an adapter that allows the user to thread the auxiliary handle to the ramrod, if desired.

Traditional straight, cylindrical ramrods tend to create difficulty and discomfort to the user after prolonged loading operations. Additional concerns result from the interaction between the ramrod and the securing thimble, which may rattle, or otherwise create unwanted noise while hunting and tracking. Some prior art ramrods have attempted to address these concerns, such as U.S. Pat. No. 9,279,637 to Hunsaker; U.S. Pat. No. 9,991,089 to Hunsaker; and U.S. Pat. No. 9,279,637 to Emerson et al. However, a need still exists for a ramrod that can be utilized with a muzzleloader that address the above-mentioned problems.

SUMMARY OF THE INVENTION

Bearing in mind the problems and deficiencies of the prior art, it is therefore an object of the present invention to provide a ramrod which requires no disassembly to use during loading or cleaning operations.

It is another object of the present invention to provide a ramrod of an adjustable length which may be overall longer than the muzzleloader barrel length in a first position, and may be collapsed into a smaller, second position which is readily stowable within the muzzleloader thimble(s).

A further object of the present invention is to provide a ramrod including a removable loading tip to allow usage of different jags to perform a plurality of operations.

It is another object of the present invention to provide an adjustable ramrod which may be locked into a position to prevent premature extension or retraction which would cause harm during loading or create unwanted noise when secured within the muzzleloader thimbles.

Still other objects and advantages of the invention will in part be obvious and will in part be apparent from the specification.

The above and other objects, which will be apparent to those skilled in the art, are achieved in the present invention which is directed to a device used with a muzzleloading firearm comprising an elongated ramrod outer body having a first end, a second end, and a longitudinal axis extending therebetween. The outer body first end may be adapted for insertion into the bore of a firearm, and the second end comprising a hollow portion, the outer body having an exterior size and shape permissible for insertion into the bore. An extension member may be movable within the outer body hollow portion from a retracted position wherein a first length of the extension member is within the outer body hollow portion, to an extended position wherein the first length of the extension member is outside the outer body hollow portion. The extension member includes a second length outside the outer body hollow portion. A clasping member may be coupled to an end of the extension member second length forming a pivot point, and may be movable between a stowed position in which the clasping member is generally aligned with the outer body longitudinal axis, and a working position in which the clasping member makes a substantial angle with respect to the outer body longitudinal axis.

In some embodiments, the device comprises a detent housing coupled to the extension member first length and the outer body hollow portion. The detent housing comprises an engagement channel extending along a length of the detent housing. A locking element of the extension member first length may engage the engagement channel as the extension member is moved from the retracted and extended positions. The locking element may extend through an opening in the outer body when the extension member is in the extended position. The detent housing may include a plurality of engagement channels, wherein the extension member includes a plurality of locking elements. The detent housing may include a locking channel extending perpendicular to the engagement channel. The detent housing may comprise a cut-out section along a length of the detent housing including a lever arm hingeably coupled to the detent housing such that a portion of the lever arm extends through an opening in the outer body when the extension member is in the extended position. The engagement channel may include a detent location such that movement of the extension member to the extended position provides tactical feedback to the user. The extension member may include a plurality of indicia or graduation along the first length, wherein each of the plurality of indicia or graduations corresponds to each of the plurality of locking channels The device may comprise a removable loading jag coupled to the outer body first end at a connection portion on an end of the loading jag, wherein the loading jag further comprises an accessory end opposite the connection portion. The accessory end may comprise a concave portion or serrated edges. The extension member may be rotatable within the outer body to a locked position wherein movement of the extension member between the extended position and the retracted position is prohibited. The extension member first length may comprise an end cap sized to engage an interior wall of the outer body hollow portion during movement of the extension member between the extended position and the retracted position.

The present invention also provides a method of using a ramrod for a muzzleloading firearm, comprising the steps of providing a ramrod comprising an elongated ramrod outer body having a hollow portion and an exterior size and shape permissible for insertion into the bore, an extension member movable within the outer body hollow portion, and a clasping member coupled to an end of an extension member second length forming a pivot point. The method comprises moving the clasping member from a stowed position in which the clasping member is generally aligned with an outer body longitudinal axis to a working position in which the clasping member makes a substantial angle with respect to the outer body longitudinal axis, and moving the extension member from a retracted position wherein a first length of the extension member is within the outer body hollow portion to an extended position wherein the first length of the extension member is outside the outer body hollow portion.

In one or more embodiments, the ramrod further comprises a detent housing coupled to the extension member first length and the outer body hollow portion, the detent housing comprising an engagement channel extending along a length of the detent housing. The extension member first length comprises a locking element engaged with the engagement channel such that locking element is moved along the engagement channel during the steps of moving the extension member from the retracted position to the extended position. The detent housing may further comprise a locking channel extending perpendicular to the engagement channel, and the method may further include the steps of rotating the extension member within the outer housing to a locked position wherein movement of the extension member between the extended position and the retracted position is prohibited. The locking element may extend through an opening in the outer body when the extension member is in the extended position such that movement of the extension member between the extended position and the retracted position is prohibited. The locking element may extend through an opening in the outer body when the extension member is rotated to the locked position.

The method may further comprise the steps of urging the locking element into the opening of the outer body, and rotating the extension member from the locked position to an unlocked position wherein movement of the extension member between the extended position and the retracted position is permitted. The method may further comprise the steps of urging the locking element into the opening of the outer body, and moving the extension member from the locked position to an unlocked position wherein movement of the extension member between the extended position and the retracted position is permitted.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIG. 3B depicts a perspective view of a portion of the ramrod according to FIG. 3A, in the extended and working position;

FIG. 3C depicts a top view of a portion of the ramrod according to FIGS. 3A and 3B, in the extended, locked, and working position;

DESCRIPTION OF THE EMBODIMENT(S)

Figure 1A:
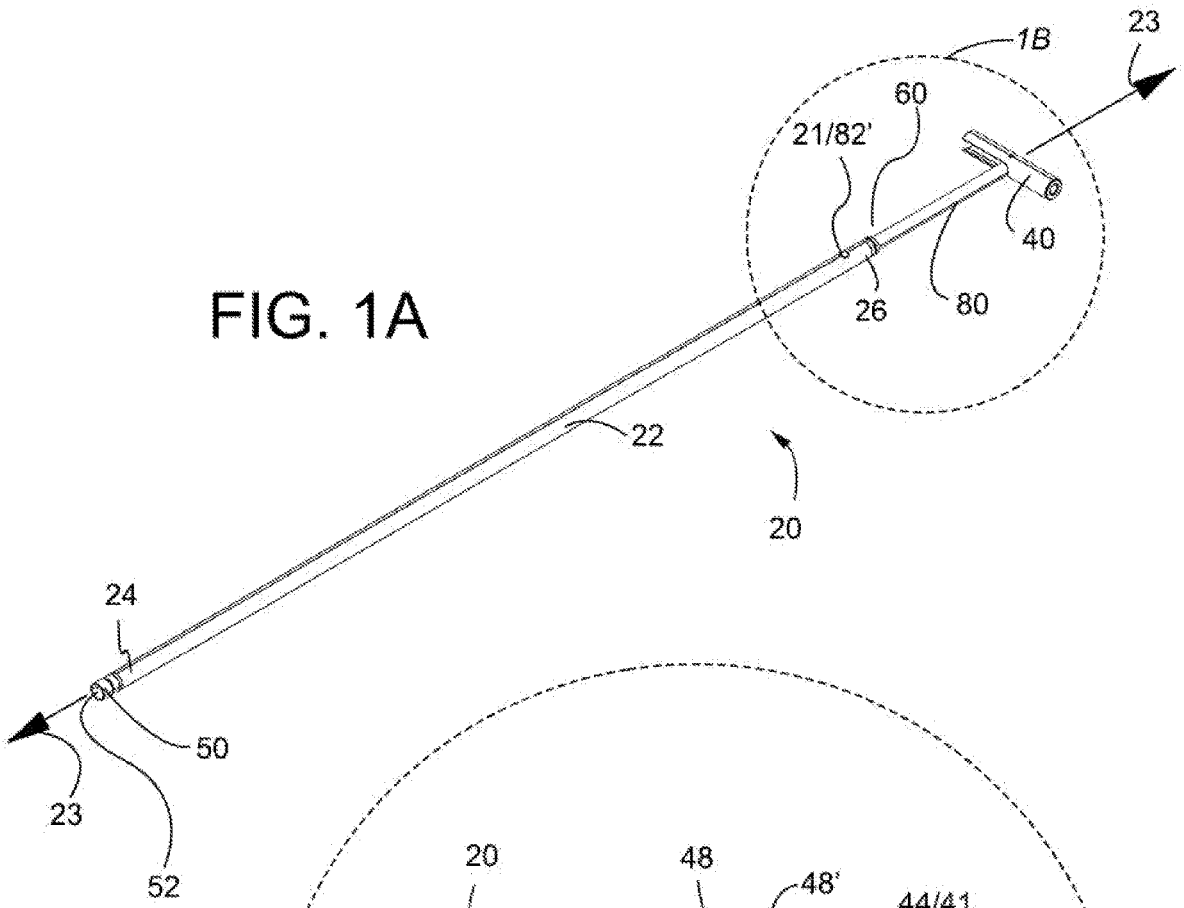
FIG. 1A depicts a perspective view of a ramrod according to an embodiment of the present invention, in a fully extended and working position.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc., may be used herein to describe various components, these components should not be limited by these terms. These terms are only used to distinguish one component from another. For example, a first element could be termed a second element, and, similarly, a second element could be termed a first element, without departing from the scope of the present invention. As used herein, the singular forms "a", "an" and "the" are intended to include the plural forms as well, unless the context clearly indicates otherwise. Also, as used herein, the term "and/or" includes any and all combinations of one or more of the associated listed items. It will be further understood that the terms "include" and/or "including" when used herein, specify the presence of stated features, steps, operations, elements, and/or components, but do not preclude the presence or addition of one or more other features, steps, operations, elements. components, and/or groups thereof.

Relative terms such as "below," "above," "upper," "lower," "horizontal." "vertical," "top," "bottom," "rear," "front," "side," or the like may be used herein to describe a relationship of one element or component to another element or component as illustrated in the figures. It will be understood that these terms are intended to encompass different orientations of the device in addition to the orientation depicted in the figures.

Additionally, in the subject description, the words "exemplary," "illustrative," or the like are used to mean serving as an example, instance or illustration. Any aspect or design described herein as "exemplary" or "illustrative" is not necessarily intended to be construed as preferred or advantageous over other aspects or design. Rather, use of the words "exemplary" or "illustrative" is merely intended to present concepts in a concrete fashion.

In describing the embodiment of the present invention, reference will be made herein to FIGS. 1-8 of the drawings in which like numerals refer to like features of the invention.

The present invention provides a ramrod which requires no disassembly to use. The ramrod may comprise an adjustable length which may be overall longer than the muzzleloader barrel length, and may be collapsed into a position which is readily secured within the muzzleloader thimble(s). The ramrod of the present invention may include a removable loading tip to allow usage of different jags to perform a plurality of operations.

Figure 1B:
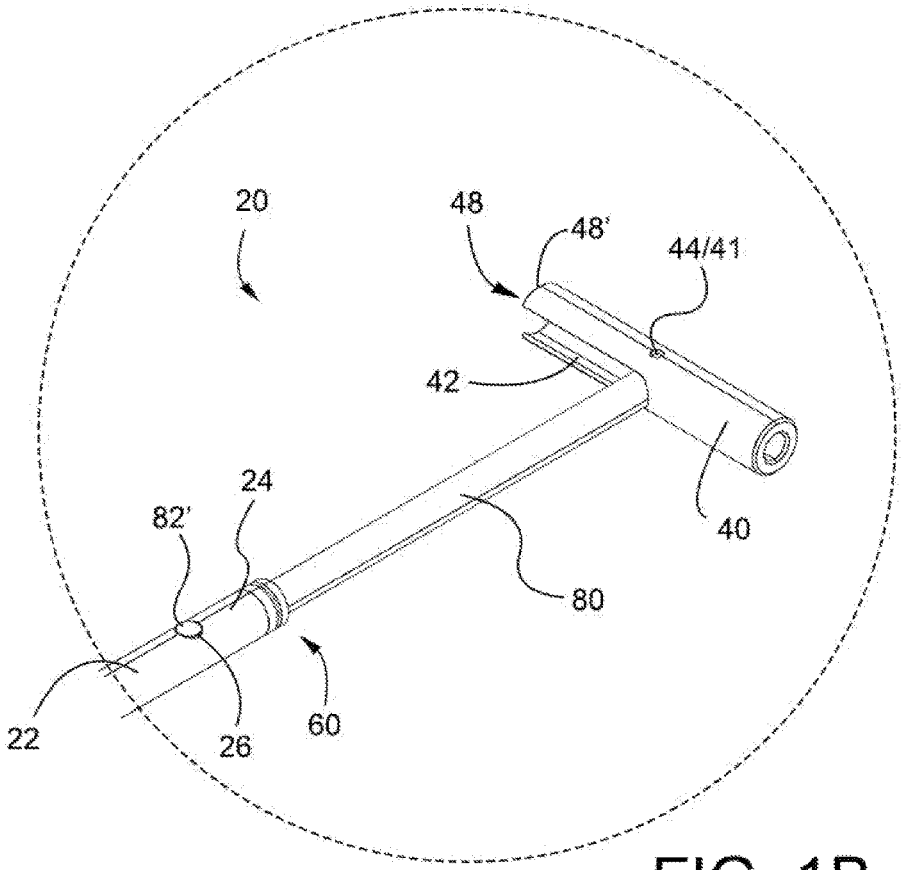
FIG. 1B depicts an enlarged perspective view of the ramrod according to FIG. 1A, showing detail portion 1B.

Referring to FIGS. 1A and 1B, ramrod 20 comprises an elongated outer body 22 consisting of a material that will provide sufficient strength for loading operations, such as steel, aluminum, brass, a reinforced carbon composite, a polymeric material, and the like. Elongated outer body 22 comprises a length extending along longitudinal axis 23, and further comprises a first end 24, and a second end 26. One or both of first and second ends 24, 26 may include a hollow portion 23*a*, 23*b* (See FIG. 4) which may extend along a portion of the elongated outer body 22 or throughout the entirety of the body. First end 24 is designed for insertion into the bore of a muzzleloader during loading or cleaning operations and may include a loading jag 50 including an accessory end 52 for cleaning and/or loading operations. Second end 26 may be grasped by a user to facilitate loading operations. The overall length of the outer body 22 may vary as necessary to ensure capability with particular muzzleloader barrels.

An inner body or extension member 80 may be included within the ramrod outer body 22 and may be movable within the outer body second end 26 from a retracted position where a portion of the length of extension member 80 is within outer body 22 (See FIG. 2), to an extended position where a portion of extension member 80 is outside outer body 22, thereby increasing the overall length of the ramrod 20.

Figure 2:
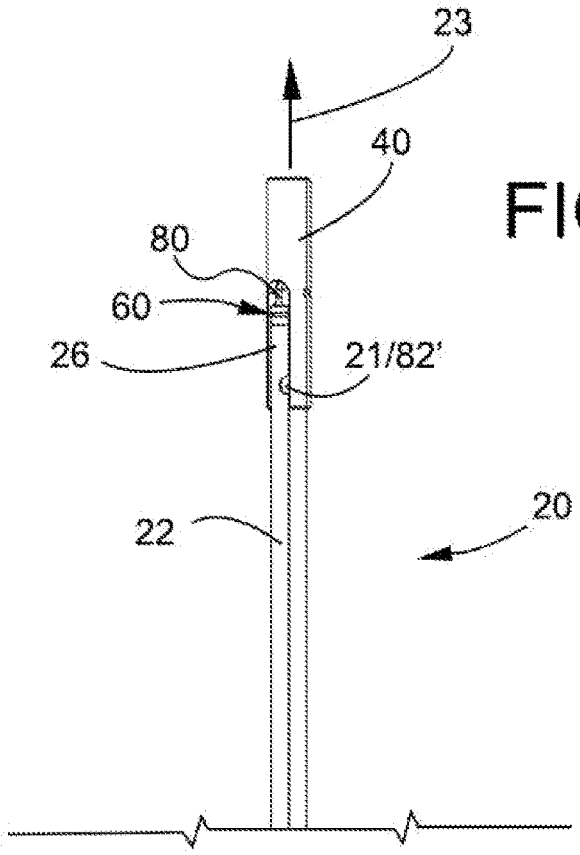
FIG. 2 depicts a segmented side view of a ramrod according to an embodiment of the present invention, in the fully retracted and stowed position.

A detent housing 60 may be installed, mounted, inserted, or otherwise attached to the hollow portion 23*b* of the body's second end 26, and is described in further detail below. An extension arm 80 may be housed within an interior portion of detent housing 60, an interior of the outer body 22, or both. Extension arm 80 includes a clasping member 40 mounted at pivot point 81 (See FIG. 4) so that clasping member 40 may be selectively folded with respect to the ramrod's body. In FIGS. 1A and 1B the clasping member is shown in a working position, wherein it makes a substantial angle (e.g., 90 degrees) with respect to the ramrod's longitudinal axis 23. Clasping member 40 may fold about a central axis that is defined by a pivot pin 41 extending through pivot point 81 and secured to the clasping member within one or more openings 44. Clasping member 40 includes a counterbore 48 at one end 48' of the clasping member, and slotted section 42 extending along a length of the clasping member between pivot pin 41 and end 48'. During operation, clasping member will be folded from the working position, as depicted in the illustrative views of FIGS. 1A and 1B, to the stowed position, such as the exemplary view of FIG. 2, so that the ramrod may be easily secured within the muzzleloader thimbles between usage. As seen in FIG. 2, clasping member is sized so as to be larger than the ramrod outer body 22, allowing the counterbore 48 of the clasping member to seat along the exterior of ramrod outer body end 24. To prevent shifting and contact between outer body 22 and clasping member 40, an O-rings, rubber grommets and the like (not shown) may be placed between the clasping member 40 and outer body 22 which would ensure secured connection of the clasping member in the stowed position, but also prevent noise due to the shifting of the ramrod when secured within the thimbles which may otherwise alert prey during hunting.

When in its working position, the clasping member 40 will provide a substantial area against which a user's palm may be pressed to facilitate loading or cleaning operations within the muzzleloader's bore.

Figure 5A:
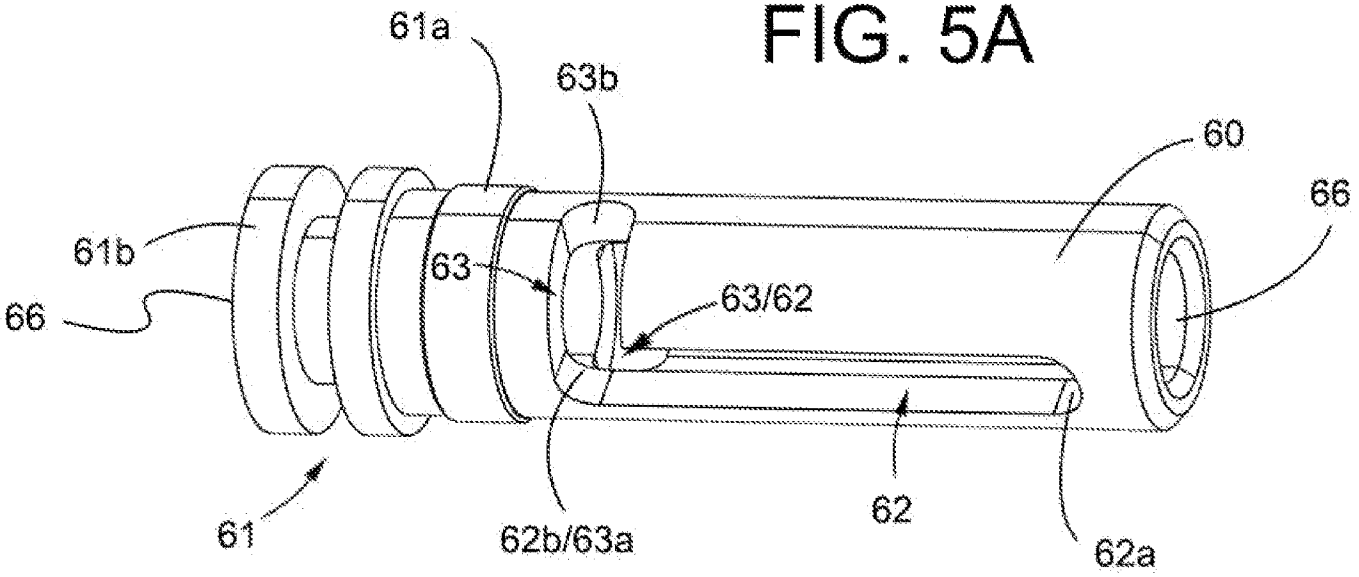
FIG. 5A depicts a perspective view of a detent housing of a ramrod according to an embodiment of the present invention.
Figure 5B:
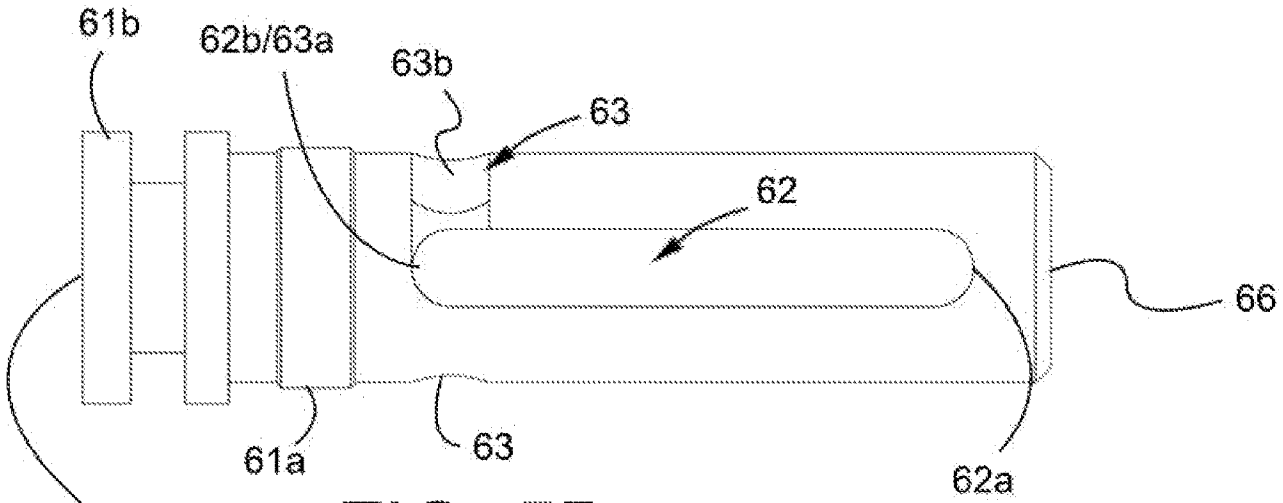
FIG. 5B depicts a side view of the detent housing of FIG. 5A.

Detent housing 60 is now further described with reference to FIGS. 5A and 5B. As depicted, detent housing comprises a central channel 66 which may extend along the length of the detent housing for insertion of extension member 80 within such that detent housing encapsulates at least a portion of extension member 80. A retaining member 61 may be placed at an end of detent housing 60 which ensure the housing is properly secured to the ramrod body. The housing may further include one or more engagement channels 62 which extend along a length of the housing in a first direction from end-to-end 62*a*, 62*b*. A locking channel 63 may intersect engagement channel end 62*b* at a locking channel end 63*a*, and extend radially along a portion of the housing 60 in a direction approximately perpendicular to engagement channel 62 from end-to-end 63*a*, 63*b*. Engagement channel(s) 62 and locking channel(s) 62*a* are sized such that they will engage a locking element such as locking protrusion 82 of the extension member therein. Detent housing may be coupled to the ramrod body at hollow portion 23*b* via retaining member 61, which may be coupled to or integral with the detent housing and comprises a plurality of annular portions 61*a*, 61*b*. Annular portion 61*b* may be sized of an outer diameter comparable to the inner diameter of ramrod body, while annular portion 61*b* may be sized to an outer diameter comparable to that of the ramrod outer body 22. Retaining portion annular portion 61*a* may be secured to hollow portion 23*b* through fasteners, epoxy, threaded engagement, and the like.

Figure 3A:
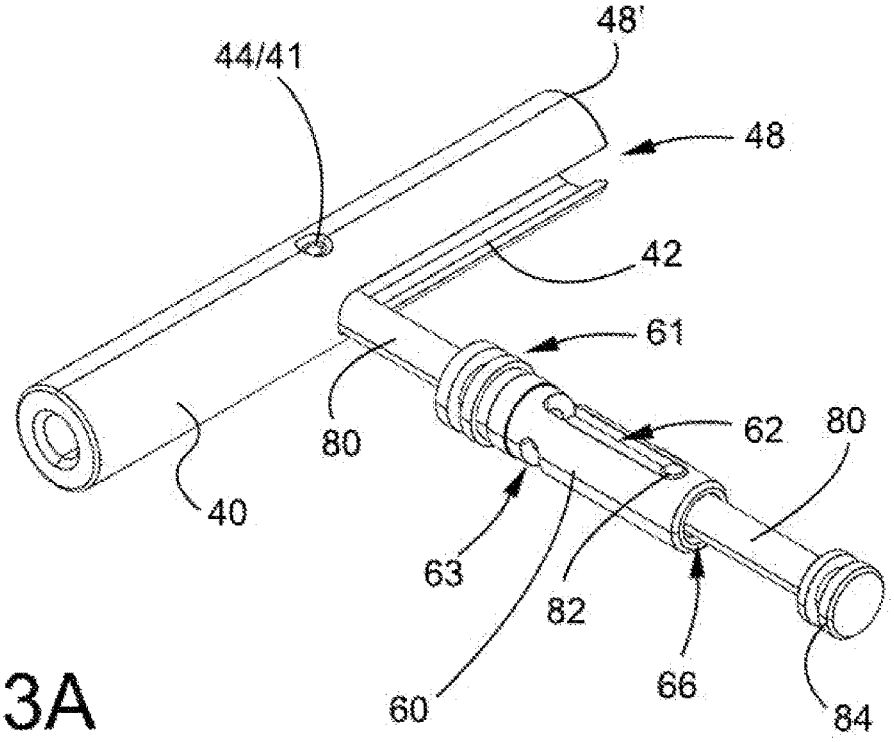
FIG. 3A depicts a perspective view of a portion of a ramrod according to an embodiment of the present invention, in the retracted and working position.
Figure 4:
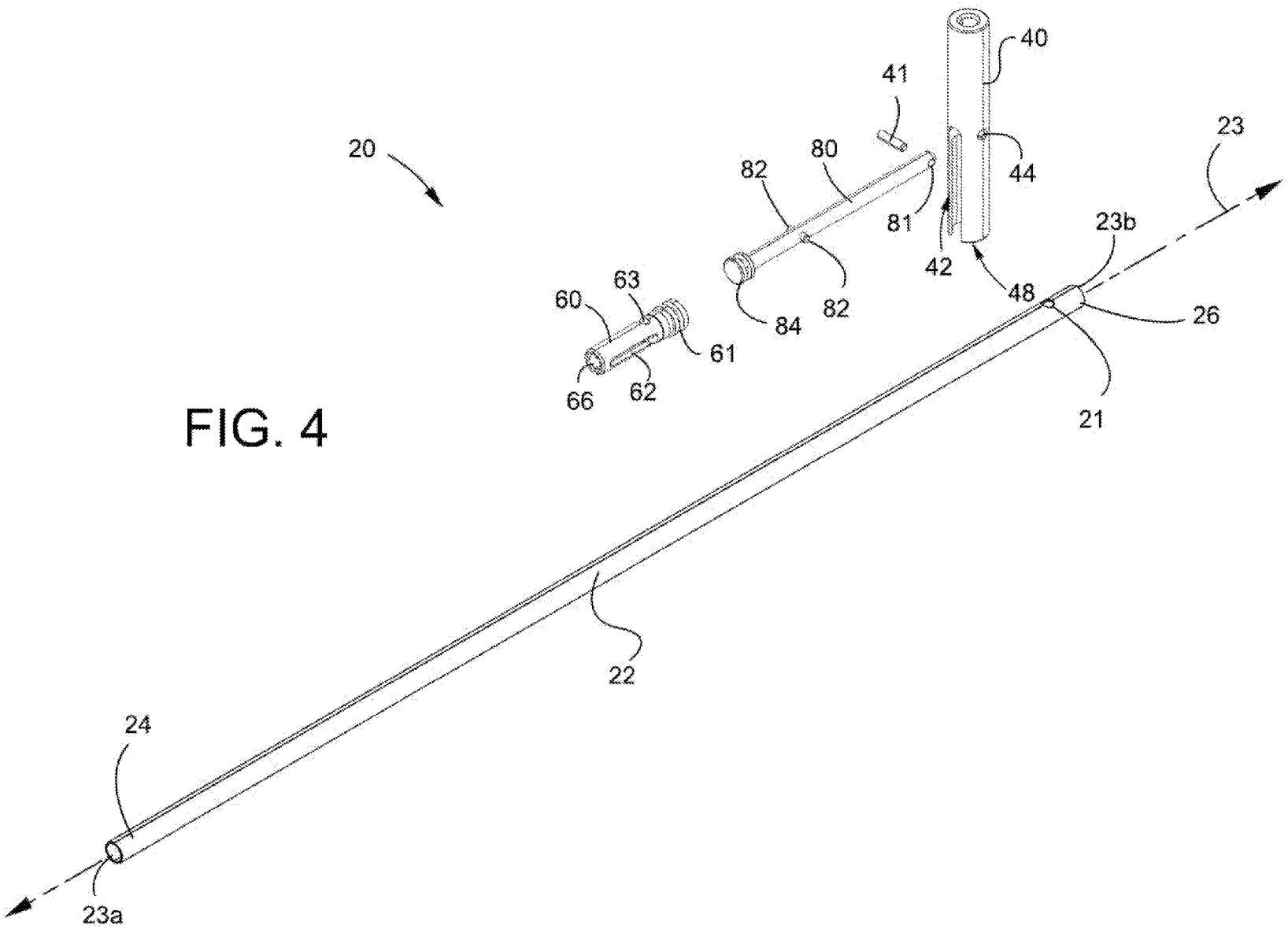
FIG. 4 depicts an exploded view of a ramrod according to an embodiment of the present invention.

Operating the extension member 80 within detent housing is now described with reference to FIGS. 3A, 3B, and 3C, which depict the ramrod in an extended and locked position (FIG. 3C), retracted position (FIG. 3A), and an extended position (FIG. 3B). While the clasping member 40 of the illustrative views is depicted in the working position, the position of the clasping member is for clarity purposes only, and the present invention is not intended to be so limited, as the ramrod may be extended/retracted with clasping member 40 in any position or mode of operation. Starting with FIG. 3A, extension member 80 is in the retracted position wherein a portion of the extension member 80 extends within the detent housing central channel 66 opposite the retaining portion 61 and may extend within the ramrod body at hollow portion 23*b* (not shown). In the retracted position, locking protrusion 82 may be in communication with engagement channel end 62*a* opposite locking channel 63. With reference to FIG. 3B, moving the extension member in direction D causes reciprocal movement of locking protrusion 82 along engagement channel 62 until reaching the extended position where locking protrusion 82 contacts the opposing channel end 63*a* that intersects with end 63*a* of locking channel 63. Upon contact of the locking protrusion with the engagement channel end 62*b*, further movement of the extension member in direction D will be prevented. Referring now to FIG. 3C, rotation of the extension member 80 in direction R causes movement of the locking protrusion within locking channel 63 towards end 63*b*, so as to secure the extension member in an extended and locked position.

In some embodiments, both ends of the engagement channel 62*a*, 62*b* may include locking channels disposed perpendicular to the engagement channel, so the ramrod may include an extended and locked position, as well as the retracted and locked position. In other embodiments of the present invention, engagement channel(s) 62 may include one or more locking channels along the length of the engagement which other embodiments would permit incremental or fractional extension of the extension member. for example, ¾ extension, ⅔ extension, ⅓ extension and ¼ extension. The engagement channel(s) may similarly include a plurality of detent locations so that the user can tactically feel the extension/retraction progress of the extension member as it is moved in direction D. Extension member may similarly include of indicia or graduations which may indicate to the user the overall length of the ramrod and may correspond with any of the plurality of locking channels, so as to ensure the proper length specified for the muzzleloader barrel.

In some embodiments, extension member 80 may comprise an endcap 84 to prevent further movement of the extension member in direction D. Endcap 84 may comprise a rigid material such as light-weight metals/alloys, or a resilient material such as an organic/inorganic polymeric material, rubber, and the like. Endcap 84 may be sized so as to engage with the interior walls of the outer body hollow portion 23*b* to prevent unnecessary movement of the extension member in the direction opposite direction D.

In some embodiments, locking protrusion(s) may be sized so as to extend from the interior of the outer body 22 to an exterior portion of the outer body upon engagement of the locking protrusion(s) 82 in an extended, or an extended and locked position. In such embodiments, the locking element may comprise a biasing element 82' (See FIGS. 1A and 1B). Biasing element 82' may be spring-loaded or constructed of an otherwise collapsible or bias-able material so as not to restrict movement operations of the extension member during extension/retraction operations, while also forming a detent mechanism between outer body 22 and extension member 80. As shown in FIGS. 1A and 1B, biasing element 82' will be biased to extend outwardly from the central ramrod axis to the exterior of the outer body 22 via opening 21, restricting movement between extension member 80 and ramrod outer body 22. After engagement of the detent, further movement of the extension member within the detent housing 60 or outer body 22 is prohibited. Upon urging biasing element 82' toward the ramrod interior, the detent mechanism will be released and extension member 80 can be moved between extended and retracted positions.

In some embodiments the detent mechanism may be engaged upon movement of the extension member to the extended position, without further rotation of the extension member to the locked position.

Figure 6A:
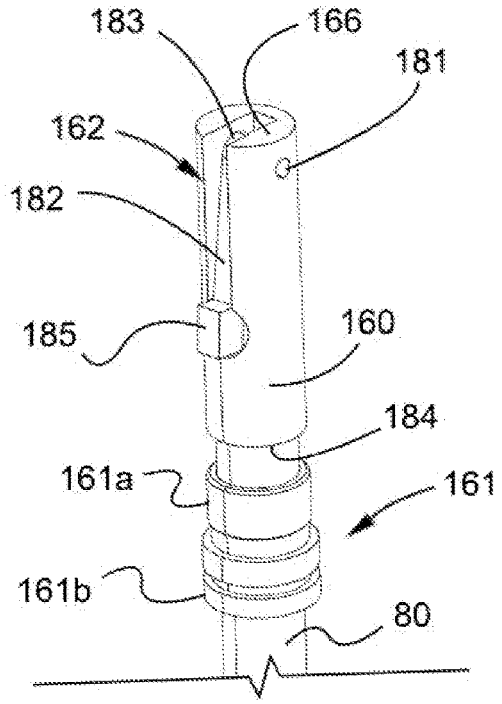
FIG. 6A depicts an enlarge perspective view of a portion of a detent mechanism of a ramrod according to an embodiment of the present invention.
Figure 6B:
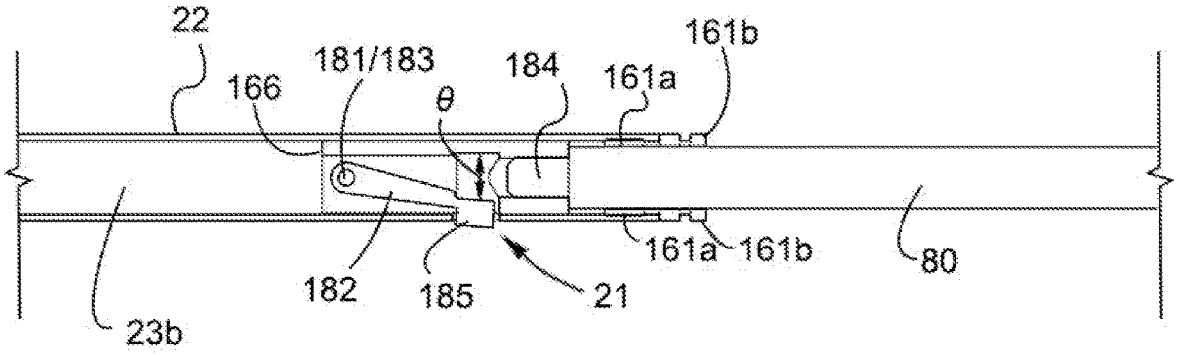
FIG. 6B depicts a cross-sectional view of a portion of a detent mechanism of a ramrod according to an embodiment of the present invention.

With reference now to FIGS. 6A and 6B, an alternative embodiment of the detent mechanism is shown. Detent housing 160 comprises a terminal section 166, and a cut-out section 162 which houses a locking element such as lever arm 182 therein. Cut-out section 162 extends along at least a portion of the length of detent housing starting at terminal section 166 to allow movement of the rotating lever arm 182 during extension/retraction operations. Lever arm 182 includes pivot end 183 and a tab end 185 opposing pivot end. Lever arm is hingeably coupled to detent housing 160 via a resilient pivot end 183, such that lever arm 182 is permitted to translate in direction θ. Lever arm 182 is normally biased outwardly toward the exterior portion of the ramrod 20, allowing tab end 185 to protrude from the detent housing 160, ramrod outer body 22, or both. Tab end 185 extends in a direction generally perpendicular to the length of lever arm 182, such that upon movement of the extension member 80 to the extended or extended and locked position, tab end 185 will be biased through opening 21 to the exterior of the ramrod body, forming a detent mechanism restricting movement between extension member 80 and ramrod outer body 22.

Extension member 80 may be coupled to detent housing 160 at end 184 within outer body 22. A retaining member 161 comprising a plurality of annular portions 161*a*, 161*b* of varying outer diameters may be placed in sliding engagement with extension member 80. Annular portion 161*a* may be sized to be received by the inner diameter of the ramrod body in a manner similar to that of the aforementioned retaining member. After coupling with the ramrod outer body 22, retaining member 161 will limit movement of the detent housing 160 to the interior portion of the ramrod body. In some embodiments, the interior of the ramrod body may include a guide track or similar mechanism to ensure proper movement and engagement of the detent mechanism as the extension member is moved to the extended and locked position. In other embodiments the detent mechanism may be engaged upon movement of the extension member to the extended and/or extended and locked position.

Figure 7A:
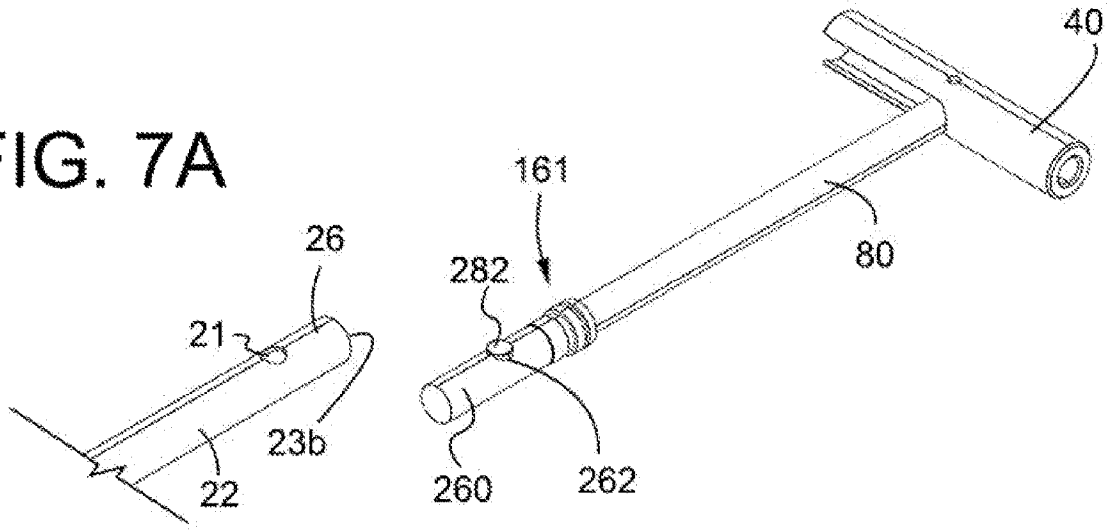
FIG. 7A depicts an exploded view of a detent mechanism of a ramrod according to an embodiment of the present invention.
Figure 7B:
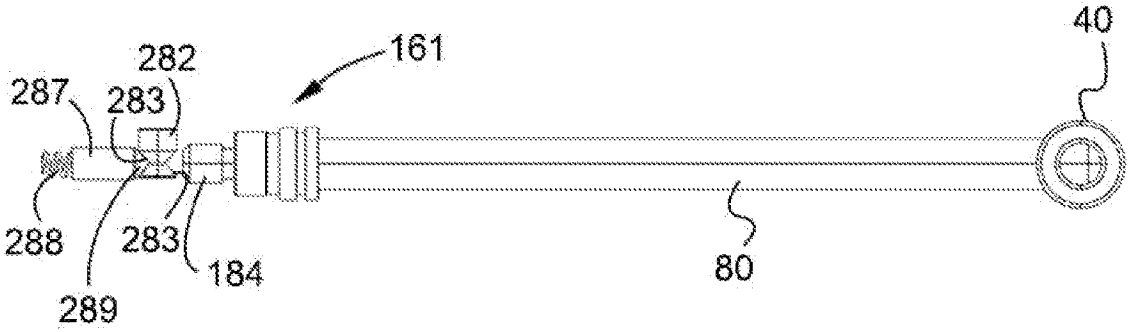
FIG. 7B depicts a partial side view of a detent mechanism of a ramrod according to an embodiment of the present invention, with ramrod outer body removed.

Turning now to FIGS. 7A and 7B, an alternative embodiment of the detent mechanism for use with the ramrod of the present invention is shown. Detent housing 260 comprises a generally cylindrical housing which includes aperture 262. The interior of detent housing 260 includes the detent assembly formed from a resilient member 288, which may comprise a spring, elastic and the like, a biasing element 287, and the locking element 282. Biasing element 287 comprises a tapered nose 289 for communication with concave portion 283 of locking element 282. Biasing element 287 is normally translated by resilient member 288 in a direction towards extension member end 184, causing the tapered nose 289 to contact concave portion 283, which results in translational movement of locking element 282 perpendicular to the translation of the biasing element. Thus, biasing element 287 will be urged to protrude from detent housing aperture 262, which will also allow the biasing element to extend to the exterior surface of the ramrod outer body 22 once placed in the extended and locked position, forming a detent mechanism in accordance with the embodiments described herein. Upon depression of the locking element 282 towards the axial center of the ramrod 20, biasing element will be translated away from the extension member end 184, such that the detent mechanism will be released and the extension member may be moved from the extended to retracted positions. Retaining member 161 will limit movement of the detent housing 260 to the interior portion of the ramrod body. In some embodiments, the interior of the ramrod body may include a guide track or similar mechanism to ensure proper movement and engagement of the detent mechanism as the extension member is moved to the extended and locked position. In other embodiments the detent mechanism may be engaged upon movement of the extension member to the extended position, without need for rotational movement.

Figure 8:
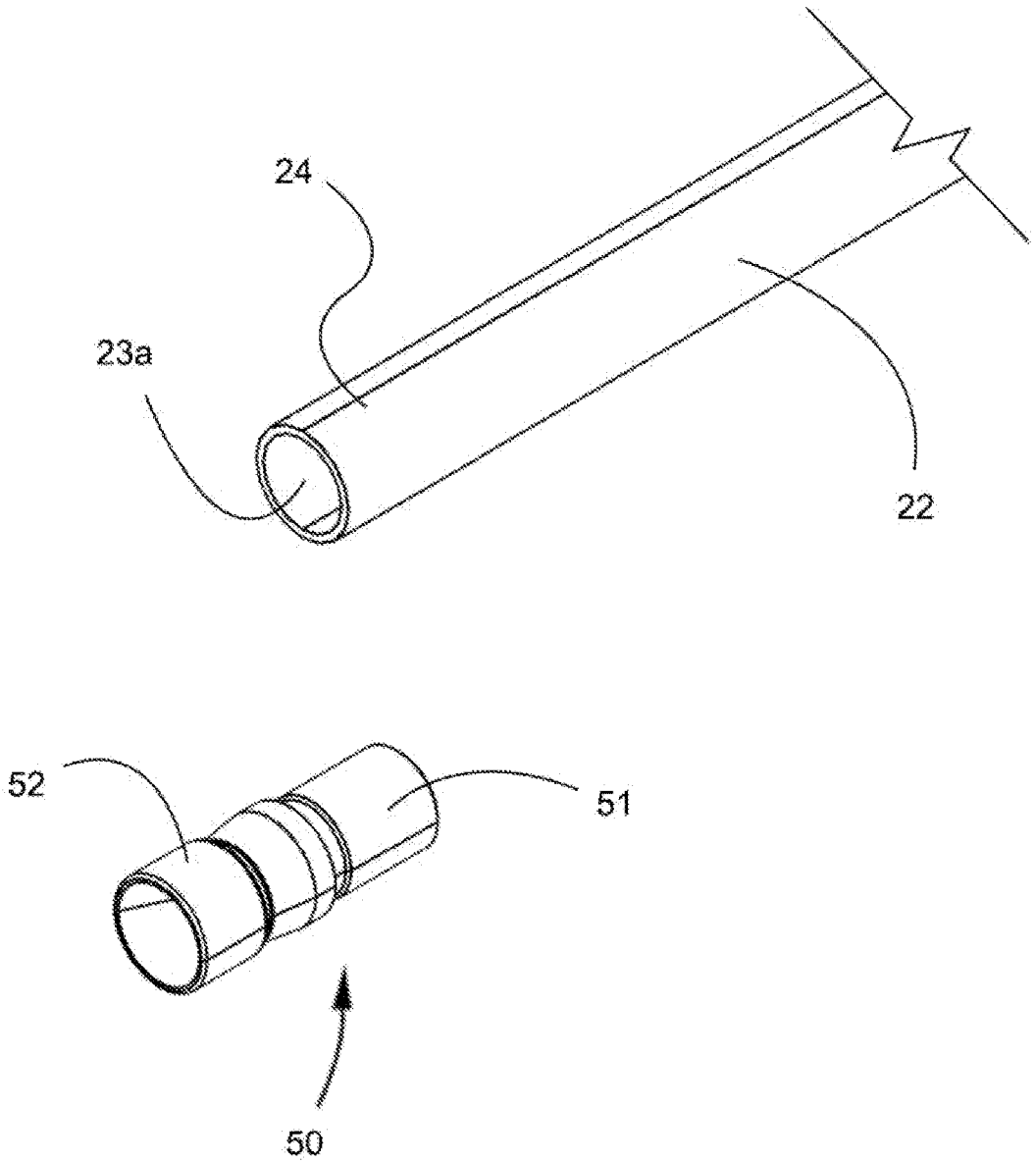
FIG. 8 depicts an enlarged exploded view of a ramrod end according to an embodiment of the present invention.

Referring now to FIG. 8, the body first end 24 is shown in connection with loading jag 50. Loading jag 50 may be removably coupled within hollow portion 23*a* of first end 24 by a connection portion 51, which may be threaded or otherwise configured for removable attachment. An accessory end 52 opposite connection portion 51 may comprise a concave portion for facilitating loading operations or serrated edges to grip a cleaning patch (not shown) during cleaning operations.

The method of using the ramrod of the present invention of one or more embodiments is described as follows. During loading operations, ramrod 20 is removed from the muzzleloader's securing thimble(s) and ramrod extension member 80 may be extended by pulling the clasping member 40 in a direction along the ramrod longitudinal axis 23. After reaching a mechanical stop or limiter, the user may rotate the extension member 80 with respect to the body axis 23. After reaching a particular angle of rotation, for example 90-degrees, a locking protrusion/biasing element may be released through the ramrod aperture 21 to the exterior of outer body 22, forming a detent mechanism between the ramrod and the extension member. The clasping member 40 may be folded into a working position subsequent to locking the extension member 80 into the extended position or may be placed into the working position prior to extension. To return the ramrod to the retracted and stowed position, the user may subsequently depress the locking protrusion/biasing element to release the detent mechanism and subsequently rotate extension member 80 to an unlocked position, where the extension member 80 may be translated back within the ramrod body interior such that extension member 80 is in the retracted position. Clasping member 40 may be subsequently folded back into the stowed position, and the ramrod may be reinserted within the thimbles until further use is necessitated.

Thus, the present invention provides one or more of the following advantages: a ramrod which requires no disassembly to use; an adjustable ramrod which can include a length longer than the muzzleloader barrel length; and a ramrod with removable loading tip to allow usage of different jags to perform a plurality of operations.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

The invention claimed is:

1. A device used with a muzzleloading firearm comprising:

an elongated ramrod outer body having a first end, a second end, and a longitudinal axis extending therebetween, said outer body first end being adapted for insertion into a bore of a firearm, said second end comprising a hollow portion, the outer body having an exterior size and shape permissible for insertion into the bore;

an extension member movable within the outer body hollow portion from a retracted position wherein a first length of the extension member is within the outer body hollow portion, to an extended position wherein the first length of the extension member is outside the outer body hollow portion, said extension member having a second length outside the outer body hollow portion; and a clasping member coupled to an end of the extension member second length forming a pivot point, said clasping member movable between a stowed position in which the clasping member is generally aligned with the outer body longitudinal axis, and a working position in which the clasping member makes a substantial angle with respect to the outer body longitudinal axis.

2. The device of claim 1 further comprising a detent housing coupled to the extension member first length and the outer body hollow portion.

3. The device of claim 2, wherein the detent housing comprises an engagement channel extending along a length of the detent housing, and wherein a locking element of the extension member first length engages the engagement channel as the extension member is moved from the retracted and extended positions.

4. The device of claim 2, wherein the locking element extends through an opening in the outer body when the extension member is in the extended position.

5. The device of claim 3, wherein the detent housing includes a plurality of engagement channels and wherein the extension member includes a plurality of locking elements.

6. The device of claim 3, wherein the detent housing includes a locking channel extending perpendicular to the engagement channel.

7. The device of claim 2, wherein the detent housing comprises a cut-out section along a length of the detent housing including a locking element hingeably coupled to the detent housing such that a portion of the locking element extends through an opening in the outer body when the extension member is in the extended position.

8. The device of claim 1, further comprising a removable loading jag coupled to the outer body first end at a connection portion on an end of the loading jag, wherein the loading jag further comprises an accessory end opposite the connection portion.

9. The device of claim 8, wherein the accessory end comprises a concave portion or serrated edges.

10. The device of claim 1, wherein the extension member is rotatable within the outer body to a locked position wherein movement of the extension member between the extended position and the retracted position is prohibited.

11. The device of claim 3, wherein engagement channel includes at least one detent location such that movement of the extension member provides tactical feedback to the user.

12. The device of claim 5, wherein the extension member includes a plurality of indicia or graduation along the first length, wherein each of the plurality of indicia or graduations corresponds to each of the plurality of locking channels.

13. The device of claim 1, wherein the extension member first length comprises an end cap sized to engage an interior wall of the outer body hollow portion during movement of the extension member between the extended position and the retracted position.

* * * * *